US010077146B2

(12) United States Patent
Burout et al.

(10) Patent No.: US 10,077,146 B2
(45) Date of Patent: Sep. 18, 2018

(54) PACKAGING TIE

(71) Applicant: AVERY DENNISON CORPORATION, Glendale, CA (US)

(72) Inventors: Charles J. Burout, Bedford, NH (US); Thomas F. Shilale, Douglas, MA (US); Daniel M. Gilbertson, Millbury, MA (US); David L. Schuttler, Townsend, MA (US); David S. Smith, Fitchburg, MA (US)

(73) Assignee: Avery Dennison Corporation, Glendale, CA (US)

( * ) Notice: Subject to any disclaimer, the term of this patent is extended or adjusted under 35 U.S.C. 154(b) by 0 days.

(21) Appl. No.: 15/411,247

(22) Filed: Jan. 20, 2017

(65) Prior Publication Data

US 2017/0210528 A1 Jul. 27, 2017

Related U.S. Application Data

(60) Provisional application No. 62/286,173, filed on Jan. 22, 2016.

(51) Int. Cl.
*B65D 69/00* (2006.01)

(52) U.S. Cl.
CPC ..... *B65D 69/00* (2013.01); *B65D 2255/20* (2013.01)

(58) Field of Classification Search
CPC ..... B65D 2255/20; B65D 69/00
See application file for complete search history.

(56) References Cited

U.S. PATENT DOCUMENTS 2,458,252 A 1/1949 Chatterton
3,112,543 A 12/1963 Derrickson
3,147,523 A * 9/1964 Logan ..... F16L 3/233 24/11 M (Continued)

FOREIGN PATENT DOCUMENTS

CN 2191836 3/1995
CN 202642430 1/2013

(Continued)

OTHER PUBLICATIONS

International Search Report and Written Opinion issued in corresponding IA No. PCT/US2017/014300 dated Mar. 27, 2017.

*Primary Examiner* — David M Upchurch
(74) *Attorney, Agent, or Firm* — Avery Dennison Corporation

(57) ABSTRACT

A tie well-suited for use in retail packaging applications includes a plastic head insert molded around one end of a paper-based cord, such as a length of twine, string or other similar environmentally-friendly material. In one embodiment, the plastic head includes a generally rectangular buckle shaped to define an elongated channel dimensioned to receive the free end of the paper-based cord. A deflectable pawl is coupled to the buckle and is naturally biased to project into the channel and selectively engage the cord in order to retain the tie in a closed loop configuration. The buckle includes a substantially open side wall through which the paper-based cord can be extracted after the tie is formed in its closed loop configuration. A clip is preferably provided on the head for selectively retaining a section of the paper-cord that has been inserted through the elongated channel.

17 Claims, 6 Drawing Sheets

(56) References Cited

U.S. PATENT DOCUMENTS

| | | | | | |
|---|---|---|---|---|---|
| 3,996,646 | A * | 12/1976 | Caveney | B65D 63/1036 | 24/16 PB |
| 4,170,299 | A * | 10/1979 | Clements | A44B 99/00 | 206/342 |
| 4,636,347 | A | 1/1987 | Kato | | |
| 4,991,265 | A * | 2/1991 | Campbell | B65D 63/1027 | 24/128 |
| 5,079,803 | A | 1/1992 | Moore | | |
| 5,377,387 | A * | 1/1995 | Freed | B65D 63/1072 | 24/16 PB |
| 5,544,391 | A * | 8/1996 | Hoffman | B65D 63/14 | 24/16 PB |
| 5,881,436 | A * | 3/1999 | Lyons | F16L 3/233 | 24/16 R |
| 2005/0146149 | A1 | 7/2005 | Agayof et al. | | |
| 2008/0110000 | A1* | 5/2008 | Orr | F16G 11/12 | 24/130 |
| 2010/0223763 | A1* | 9/2010 | Shilale | B65D 63/1072 | 24/16 PB |
| 2011/0211930 | A1* | 9/2011 | Digman | B60P 7/0815 | 410/115 |
| 2012/0084948 | A1* | 4/2012 | Breen, IV | B65D 63/1018 | 24/16 R |
| 2013/0205545 | A1 | 8/2013 | Zantout et al. | | |
| 2014/0150214 | A1* | 6/2014 | Preston | B60P 7/0823 | 24/265 R |
| 2015/0266636 | A1* | 9/2015 | Zantout | B65D 63/1018 | 24/16 R |

FOREIGN PATENT DOCUMENTS

| | | |
|---|---|---|
| CN | 202865673 | 4/2013 |
| CN | 202880020 | 4/2013 |
| DE | 716609 | 1/1942 |
| JP | 2002068277 | 3/2002 |
| KR | 20050044792 | 5/2005 |

* cited by examiner

PACKAGING TIE

CROSS-REFERENCE TO RELATED APPLICATIONS

The present application claims priority to and the benefit of U.S. Provisional Patent Application No. 62/286,173 filed on Jan. 22, 2016, which is incorporated herein by reference in its entirety.

FIELD OF THE INVENTION

The present invention relates generally to the retail industry and more particularly to ties designed primarily for use in retail packaging.

BACKGROUND OF THE INVENTION

Ties that can be formed into closed loops are well-known and widely utilized in a variety of different industries to couple together two or more separate items.

For instance, in the electrical industry, ties are commonly utilized to bundle together a plurality of elongated objects, such as wires or cables, this type of tie being often referred to in the art as a cable tie or bundling tie. One style of cable tie which is well known and widely used in the art includes an apertured head disposed onto one end of an elongated strap. The opposite end of the elongated strap is typically shaped to define a tail of narrowed width that is adapted for fitted insertion through the apertured head to form a closed loop. A plurality of serrations, or teeth, is formed on one surface the elongated strap along a portion of its length. Additionally, an internal pawl, or locking tang, is provided within the apertured head and is adapted to sequentially engage the serrations on the strap. In this manner, the engagement of the internal pawl with the serrated strap is used to lock the cable tie in a closed loop configuration.

Cable ties of the type as described above are traditionally molded using a suitable plastic material, such nylon, polypropylene or the like. Most commonly, cable ties are constructed as unitary items that are formed through injection molding. However, an increasing number of cable ties are formed as two separately molded plastic components, this type of cable tie being commonly referred to in the art as a two-piece cable tie.

A two-piece cable tie is typically constructed with the head and the strap formed through two separate molding processes. Coupling of the separately formed components is typically achieved either by driving a fastening element (e.g., a rivet) through overlying segments of the two components or by insert molding one component (e.g., the head) around a portion of the other component (e.g., the strap). The aforementioned process of constructing a two-piece cable tie is detailed in U.S. Pat. No. 6,863,855 to T. Shilale and U.S. Pat. No. 8,510,918 to T. Shilale et al., the disclosures of both references being incorporated herein by reference as are commonly assigned with the instant application.

In the retail industry, ties are also commonly utilized to secure an item, such as a toy, to its associated packaging, this type of tie being referred herein as a packaging tie. Packaging ties are commonly constructed as an elongated, unitary cord, or string, that is preferably constructed out of a recyclable and/or biodegradable material, such as a paper-based twine or string. In use, the cord is manually wrapped around and/or fed through openings formed in the objects to be coupled together and pulled tight. While holding the cord in a taut condition, the free ends are then manually formed into a knot to form the tie into a closed loop that reliably secures the items together. As an additional step in the process, a supply of tape may optionally be affixed to the packaging over the knot to prevent premature untying.

Although well-known in the art, the use of packaging ties of the type as described above has been found to suffer from a number of notable shortcomings.

As a first shortcoming, the aforementioned process of manually cinching and tying the free ends of the packaging tie is both labor-intensive and time-consuming. Accordingly, the use of conventional packaging ties has been found to increase packaging costs.

As a second shortcoming, the aforementioned process of manually cinching and tying the free ends of the packaging tie introduces a considerable variance in packaging tension. This variance in tension afforded by conventional packaging ties has been found to be unacceptable in certain applications.

As a third shortcoming, the process of ultimately untying or cutting a packaging tie is not only time-consuming and but also necessitates a certain level of manual dexterity. As a result, this difficulty in being able to separate a purchased item from its packaging often serves as a source of frustration for the end user.

SUMMARY OF THE INVENTION

It is an object of the present invention to provide a new and improved tie that can be formed into a closed loop to couple together two or more items.

It is another object of the present invention to provide a tie as described above that is suitably designed for use in retail and/or industrial packaging applications.

It is yet another object of the present invention to provide a tie as described above that is at least partially constructed out of a recyclable and/or biodegradable material.

It is still another object of the present invention to provide a tie as described above that can be formed into a closed loop configuration in a quick and easy manner.

It is yet still another object of the present invention to provide a tie as described above that can be released from its closed loop configuration in a quick and easy manner.

It is another object of the present invention to provide a tie as described above that can be formed into a closed loop configuration with a range of tension.

It is yet still another object of the present invention to provide a plastic fastener as described above that has a limited number of parts, is simple to use and is inexpensive to manufacture.

Accordingly, as one feature of the present invention, there is provided a tie comprising (a) a paper-based cord having a first end and a second end, and (b) a plastic head insert molded around the first end of the paper-based cord, the plastic head being adapted to receive and selectively engage the paper-based cord to retain the tie in a closed loop configuration.

It is another feature of the present invention to provide a multitude of ties as described above on a spool or reel. The multitude of ties comprise of a continuous paper-based cord with plastic head inserts molded at a constant pitch along the continuous paper-based cord. The paper-based cord may be scored or notched at the intersection between the paper-based cord and each plastic head insert to ease singulation of each tie.

It is yet another feature of the present invention to provide a plastic fastener that may have a living hinge feature such that the plastic head insert may be molded in a direction perpendicular to the paper-based cord, which allows for a continuous paper-based cord with a multitude of plastic head, inserts to be packaged on a reel. When a tie is cut from the reel containing a section of paper based cord and a plastic head insert, the living hinge feature allows the plastic head insert to rotate up to 90 degrees and place the plastic head insert in line with the paper based cord when the tie is tensioned.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE INVENTION

Construction of Packaging Tie 11

Figure 1:
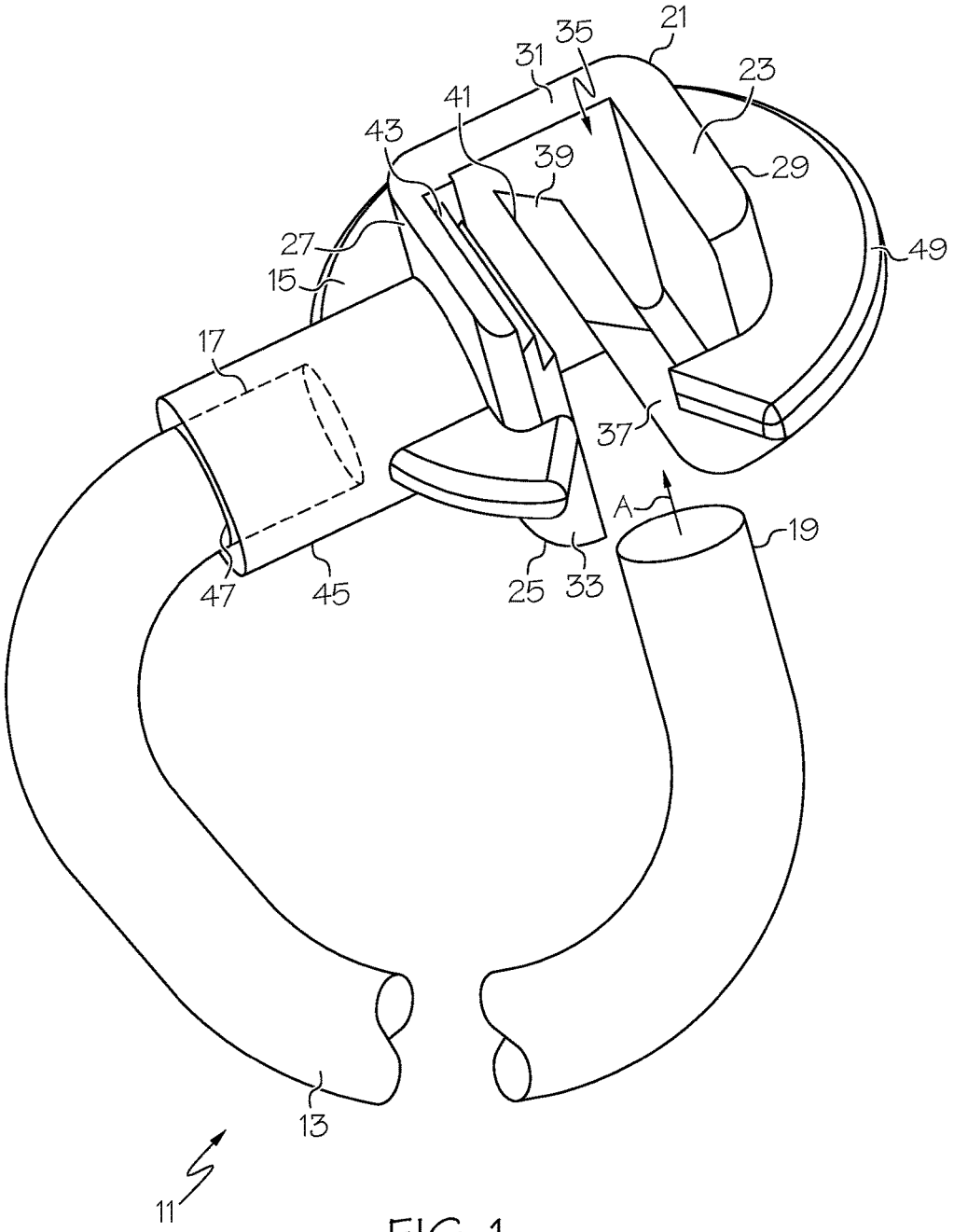
FIG. 1 is a fragmentary, top perspective view of a first embodiment of a tie constructed according to the teaching of the present invention, the free end of the cord being shown directed towards the head in order to form the tie into a closed loop configuration.

Referring now to FIG. 1, there is shown a first embodiment of a tie constructed according to the teachings of the present invention, the tie being identified generally by reference numeral 11. As will be explained further in detail below, tie 11 is designed to be releasably secured in a closed loop configuration in order to, inter alia, couple together two or more separate items.

For illustrative purposes only, tie 11 is described in detail below as being particularly well-suited for use in retail packaging applications. For this reason, tie 11 is also referred to herein as packaging tie 11. However, it should be noted that tie 11 is not limited to use in retail packaging applications. Rather, it is to be understood that tie 11 could be used in other suitable applications that require the coupling together of two or more separate items without departing from the spirit of the present invention.

Packaging tie 11 comprises an elongated, paper-based cord 13 and a separate plastic head 15. To permanently join cord 13 and head 15 together to yield unitary packaging tie 11, plastic head 15 is insert molded around a portion of cord 13, as will be explained further in detail below.

Cord 13 is preferably constructed as an elongated length of a paper-based twine or string that has a first end 17 and a second end 19. For instance, cord 13 may be formed by twisting or braiding together one or more lengths of paper-based material to create a single, elongated strand. Additionally, the present invention contemplates that in addition to paper, cord 13 may be constructed from a wide variety of materials known in the art such as, but not limited to, cotton, rayon, nylon polyester, leather, or wool materials.

In the present embodiment, cord 13 is provided with a generally circular transverse cross-section along the majority of its length. However, it should be noted that cord 13 is not limited to a generally circular cross-section. Rather, it is to be understood that cord 13 could be constructed in alternative configurations in transverse cross-section (e.g., with a generally oval configuration in transverse cross-section) without departing from the spirit of the present invention.

It should be noted that, due to its paper-based construction, cord 13 is recyclable. The present invention further contemplates that the cord may also be biodegradable. As a result of its environmentally-friendly construction, cord 13 is particularly well-suited for widespread use in retail packaging applications, which is a principal object of the present invention.

As referenced briefly above, head 15 is preferably constructed as a unitary plastic member that is insert molded around first end 17 of cord 13. In this manner, upon completion of the molding process, head 15 is permanently joined to first end 17 of cord 13 to form unitary packaging tie 11. As will be explained further in detail below, the inclusion of head 15, as well as its particular design, greatly facilitates the process of both forming tie 11 into a closed loop configuration and subsequently releasing, or opening, the closed loop, both of which are principal objects of the present invention.

Plastic head 15 comprises a buckle 21 that is in the form of an enlarged, generally rectangular block that is shaped to include an open top wall 23, an open bottom wall 25, an enclosed inner end wall 27, an enclosed outer end wall 29, an enclosed left sidewall 31, and an open right sidewall 33 that together define an elongated channel 35 that extends through head 15 from top wall 23 to bottom wall 25. As can be seen, elongated channel 35 is generally rectangular in transverse cross-section and is appropriately dimensioned to coaxially receive a section of cord 13.

Head 15 additionally comprises a deflectable pawl, or locking tang, 37 that is pivotally coupled to outer end wall 29 along bottom wall 25. Pawl 37 is naturally oriented to project into elongated channel 35 and selectively engage cord 13, as will be explained further below.

Pawl 37 is represented herein as a generally planar member with a rectangular shape in transverse cross-section.

Pawl 37 includes a free end, or flat distal surface, 39 that tapers so as to define a sharpened inner edge, or tip, 41. Similarly, a plurality of ratchet-shaped teeth 43 are integrally formed into inner end wall 27 along top wall 23. As can be appreciated, edge 41 of pawl 37 and teeth 43 in inner end wall 27 directly oppose one another and are naturally biased apart a fixed distance that is less than the diameter of cord 13. In this capacity, edge 41 and teeth 43 are arranged to engage opposite sides of cord 13 when tie 11 is formed into its closed loop configuration, as will be explained further below.

A tubular stem, or neck, 45 projects orthogonally out from the outer surface of inner end wall 27. Stem 45 is sized and shaped to over-mold molten plastic over and onto cord 13.

As part of the molding process, first end 17 of cord 13 is inserted into the mold used to form head 15. Molten plastic (e.g., nylon, polypropylene (PP), acrylonitrile butadiene styrene (ABS), polyethylene terephthalate (PET), recycled PET, styrene acrylonitrile (CAN) or any mixture thereof) is injected into the mold around first end 17 of cord 13 until the impressions in the mold are filled. The molten plastic is then allowed to harden, which in turn permanently bonds paper-based cord 13 to plastic head 15

Accordingly, it is to be understood that the resultant bore 47 is formed into stem 45 by first end 17 of cord 13 as head 15 is insert molded there around. Consequently, the dimensions of bore 47 are identical to the outer configuration of cord 13 at first end 17. As such, if the cross-sectional configuration of cord 13 were to be modified, the cross-section of bore 47 would be altered in a corresponding fashion.

An outwardly extending flange 49 is integrally formed onto and protrudes radially outward from buckle 21. Flange 49 is in the form of a flattened shelf that protrudes radially out from the approximate midsection of outer end wall 29, left sidewall 31 and inner end wall 27 in a nearly continuous manner, with a limited portion of flange 49 being interrupted by stem 45.

The free, or distal, end of flange 49 is curved, or rounded. In this manner, flange 49 provides head 15 with a rounded, almost circular, outer footprint, thereby limiting any potential risk of damage to the packaging with which it is to be used. Flange 49 also serves to provide structural integrity (i.e., a stiffening effect) to head 15.

It should be noted that flange 49 does not extend across open right sidewall 33. As a result, access to pawl 37 as well as the portion of cord 13 located within channel 35 can be readily achieved through the right side of head 15. This construction facilitates releasing tie 11 when formed into its closed loop configuration, as will be explained further below.

Illustrative Use of Packaging Tie 11

As referenced briefly above, tie 11 is particularly well-suited for use in retail packaging applications. Specifically, for use in this capacity, cord 13 is first wrapped around and/or inserted through openings in the one or more items to be coupled together (e.g., around a toy and through holes formed in a cardboard package for the toy). Second end 19 of cord 13 is then pulled tight, thereby securing the items together, and directed towards bottom wall 25 of head 15.

Second end 19 of cord 13 is then fed through channel 35 through bottom wall 25 in the direction as represented by arrow A in FIG. 1. Because the diameter of cord 13 is greater than the spacing between edge 41 of pawl 37 and teeth 43 on inner end wall 27, the continued insertion of cord 13 into channel 35 causes pawl 37 to deflect outward and pivot to the extent necessary so that first end 19 can exit channel 35 through top wall 23.

With tie 11 formed into a closed loop, it is to be understood that edge 41 on pawl 37 and teeth 43 on inner end wall 27 engage opposite sides of cord 13 and thereby prevent rearward withdrawal. As a result, tie 11 remains securely retained in its closed loop configuration with a constant and reliable degree of tension, which is a principal object of the present invention.

When release of tie 11 from its closed loop configuration is required, cord 13 can be easily extracted out through open right sidewall 33 by applying a lateral force on the readily accessible cord 13. To facilitate in the extraction of cord 13, manual outward deflection of pawl 37 can be applied to disengage pawl 37 and teeth 43 from cord 13.

Features and Advantages of Packaging Tie 11

As referenced briefly above, packaging tie 11 is specifically designed with a number of notable design features. In particular, the use of a paper-based cord 13 that can be releasably secured into a closed loop by a plastic head 15 introduces a number of notable advantages.

As a first feature, due to its paper-based construction, cord 13 is both biodegradable and recyclable. Consequently, the environmentally-friendly construction of cord 13 renders tie 11 well-suited for widespread use in retail packaging applications. In addition, the use of a relatively inexpensive paper-based cord 13 serves to minimize overall manufacturing costs.

As a second feature, the construction of head 15 enables cord 13 to be easily secured into a closed loop through insertion through elongated channel 35. By contrast, conventional packaging ties require the time-consuming and highly dexterous task of twisting and/or knotting of each tie to retain it in a closed loop configuration.

As a third feature, the construction of head 15 enables cord 13 to be easily opened from its closed loop configuration by simply extracting cord 13 laterally outward through open right sidewall 33. By comparison, conventional packaging ties require the end user to either manually untie a knot or sever the tie with a cutting instrument, both of which have been found to be highly undesirable.

As a fourth feature, the use of plastic head 15 to secure cord 13 in its closed loop configuration generally imparts a relatively limited degree of variance in cord tension. By contrast, the process of manually cinching and tying traditional ties creates a considerable amount of tie tension variance from package to package (e.g., based on the manual dexterity of the packaging operator), this tension variance having being found to be undesirable in the art.

Alternative Constructions and Design Modifications

The embodiment shown above is intended to be merely exemplary and those skilled in the art shall be able to make numerous variations and modifications to it without departing from the spirit of the present invention. All such variations and modifications are intended to be within the scope of the present invention as defined in the appended claims.

Figure 2:
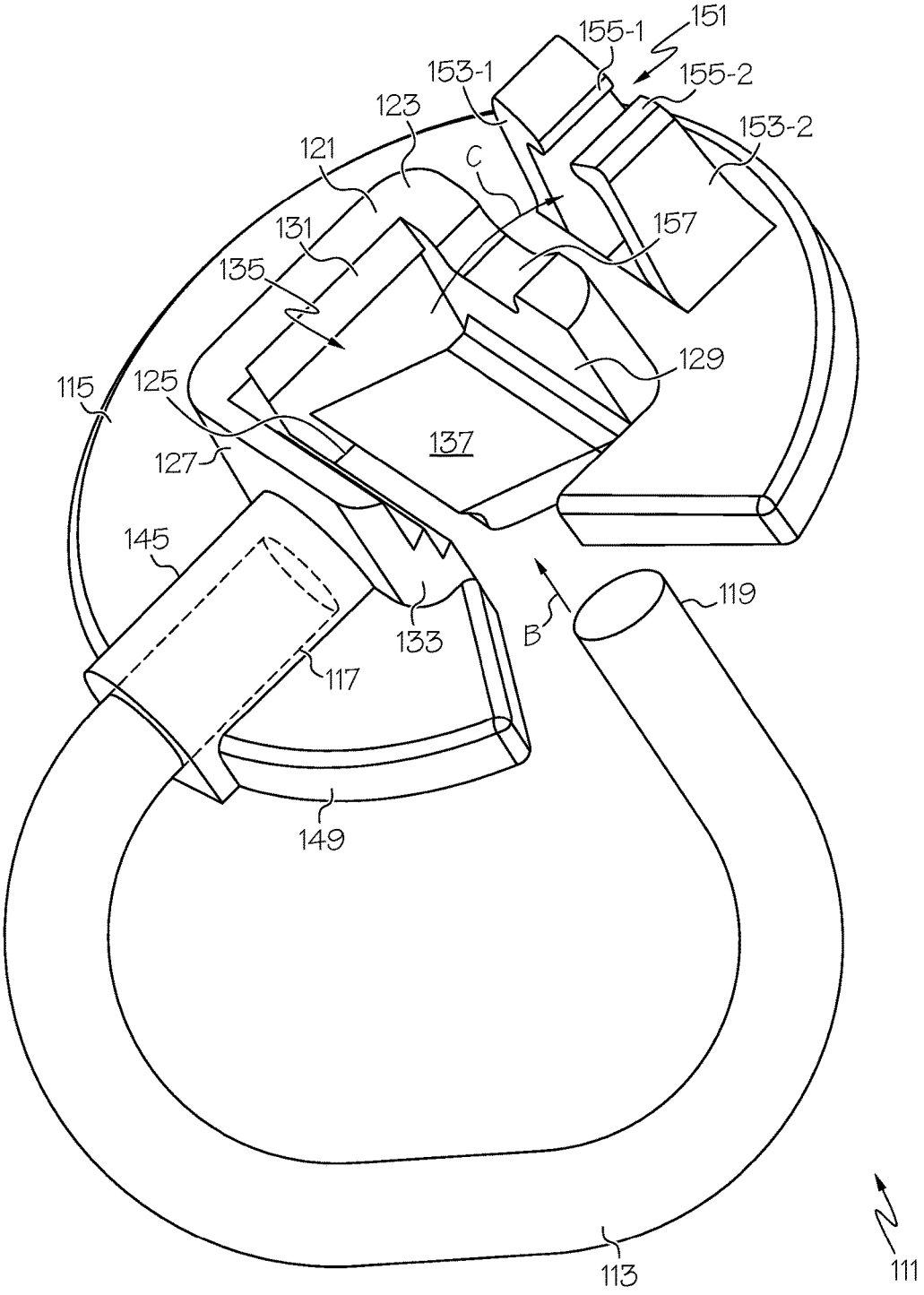
FIG. 2 is a fragmentary, top perspective view of a second embodiment of a tie constructed according to the teaching of the present invention, the free end of the cord being shown directed towards the head in order to form the tie into a closed loop configuration.

For example, referring now to FIG. 2, there is shown a second embodiment of a tie constructed according to the teachings of the present invention, the tie being identified generally by reference numeral 111. In use, tie 111 functions similarly to tie 11 in that tie 111 can be releasably secured in a closed loop configuration in order to, inter alia, couple together two or more separate items.

Tie 111 is similar in construction to tie 11 in that tie 111 comprises an elongated, paper-based cord 113 and a separate plastic head 115 that are permanently joined together by insert molding head 115 around a portion of cord 113. Further, by inserting the free end of cord 113 through plastic head 115, tie 111 can be retained in a closed loop configuration.

Cord 113 is similar to cord 13 in that cord 113 is preferably constructed as an elongated length of a paper-based twine or string that has a first end 117 and a second end 119. However, cord 113 differs slightly from cord 13 in that cord 113 has a D-shaped or oval cross-section along the majority of its length.

Head 115 is similar to head 15 in that head 115 is preferably constructed as a unitary plastic member that includes a buckle 121 in the form of an enlarged, generally rectangular block shaped to include an open top wall 123, an open bottom wall 125, an enclosed inner end wall 127, an enclosed outer end wall 129, an enclosed left sidewall 131, and an open right sidewall 133. Together, walls 123 thru 133 define an elongated channel 135 that extends through head 115 from top wall 123 to bottom wall 125 and is appropriately dimensioned to coaxially receive a section of cord 113.

Head 115 is also similar to head 15 in that head 115 comprises a deflectable pawl, or locking tang, 137 that is pivotally coupled to outer end wall 129 along bottom wall 125 and is naturally oriented to project into elongated channel 135 and selectively engage cord 113.

Head 115 is further similar to head 15 in that head 115 includes both a stem, or neck, 145 that projects orthogonally out from the outer surface of inner end wall 127 and an outwardly extending flange 149 that is integrally formed onto and protrudes radially outward from buckle 121. Although the cross-sectional configuration of stem 145 differs slightly from stem 45 and the location of flange 149 is slightly lower (namely, along and generally flush with bottom wall 125 of buckle 121), the designated functions of stem 145 and flange 149 are largely the same as the designated functions of stem 45 and flange 49, respectively, in tie 11.

The primary distinction between tie 111 and tie 11 is that tie 111 includes a cable holder, or clip, 151 that is formed onto the topside of flange 149 along its outer end in a spaced apart relationship relative to buckle 121. Clip 151 includes a pair of opposing, spaced apart, outwardly deflectable fingers 153-1 and 153-2 that are designed to releasably engage and retain a length of cord 113 therebetween.

Accordingly, in use, second end 119 of cord 113 is designed to be fed through channel 135 through bottom wall 125 in the direction as represented by arrow B in FIG. 2 (i.e., in a similar fashion to the above-described use of tie 11). Once cord 113 passes between pawl 137 and inner end wall 127 (and is wedged therebetween to retain tie 111 in its closed loop configuration), second end 119 is pivoted outward and down, as represented by arrow C in FIG. 2. A continuous downward force is applied to second end 119 of cord 113 so that angled, inwardly projecting free ends 155-1 and 155-2 of fingers 153-1 and 153-2, respectively, separate to the extent necessary that cord 113 can be disposed therebetween. Preferably, a U-shaped recess 157 is formed in the top surface of outer end wall 129 to promote the proper alignment and positioning of cord 113 within clip 151.

When release of tie 11 from its closed loop configuration is required, second end 119 of cord 113 is pulled up and with suitable force so as to disengage from clip 151. Thereafter, cord 113 can be easily extracted out through open right sidewall 133. To facilitate in the lateral extraction of cord 113, manual outward deflection of pawl 137 can be applied to disengage pawl 137 from cord 113.

Figure 3:
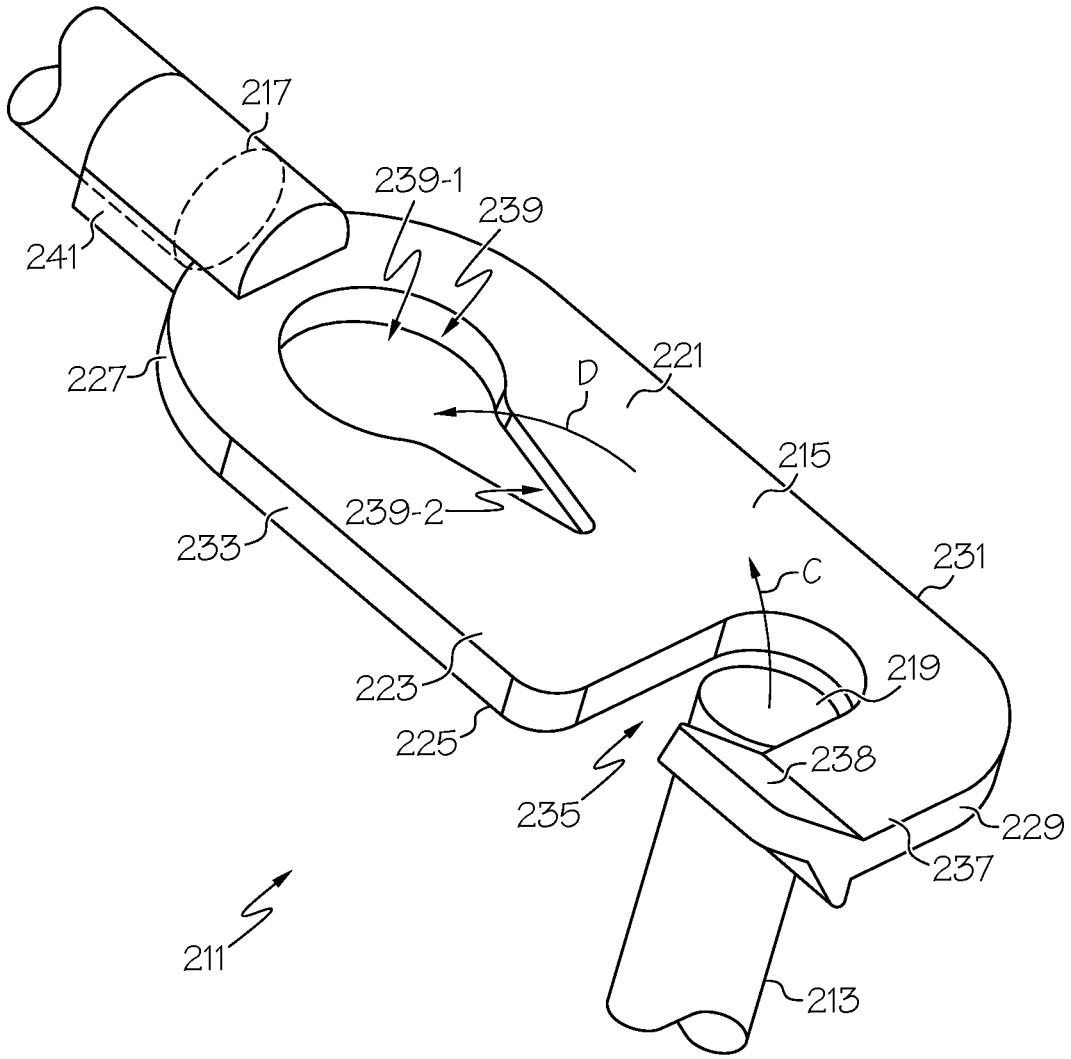
FIG. 3 is a fragmentary, top perspective view of a third embodiment of a tie constructed according to the teaching of the present invention, the free end of the cord being shown directed towards the head in order to form the tie into a closed loop configuration.

Referring now to FIG. 3, there is shown a third embodiment of a tie constructed according to the teachings of the present invention, the tie being identified generally by reference numeral 211. In use, tie 211 functions similarly to tie 11 in that tie 211 can be releasably secured in a closed loop configuration in order to, inter alia, couple together two or more separate items.

Tie 211 is similar in construction to tie 11 in that tie 211 comprises an elongated, paper-based cord 213 and a separate plastic head 215 that are permanently joined together by insert molding head 215 around a portion of cord 213. Further, by inserting the free end of cord 213 through plastic head 215, tie 211 can be retained in a closed loop configuration.

Cord 213 is similar to cord 113 in that cord 213 is preferably constructed as an elongated length of a paper-based twine or string that has a first end 217 and a second end 219. Cord 213 is also similar to cord 113 in that cord 213 has a circular cross-section along the majority of its length.

Head 215 is similar to head 15 in that head 215 is preferably constructed as a unitary plastic member that is designed to selectively engage a portion of cord 213 to retain tie 211 in a closed loop configuration. Head 215 differs from head 115 primarily in that head 215 includes an enlarged planar tab, or platform, 221 instead of a generally rectangular, block-shaped buckle.

Tab 221 is a unitary member that includes a flat top surface 223, a flat bottom surface 225, a curved inner end wall 227, a straightened outer end wall 229, an elongated, straightened, left sidewall 231, and an elongated, straightened, right sidewall 233. An arcuate recess 235 extends partially into right sidewall 233 so as to define a narrow hook, or slightly flexible finger, 237 in tab 221 along outer end wall 229, the distal end 238 of finger 235 extending upward at an obtuse angle relative to top surface 223 of the remainder of tab 211.

Tab 221 is additionally shaped to define a transverse opening, or hole, 239 proximate inner end wall 227. As can be seen, hole 239 includes a circular portion 239-1 dimensioned to receive cord 213 and a narrow triangular portion 239-2 that extends radially outward from circular portion 239-1 in communication therewith (i.e., to provide hole 239 with an ice cream cone shape).

A stem, or neck, 241 is integrally formed onto and projects orthogonally out from curved inner end 227. Stem 241 is similar to stem 145 in that stem 241 is insert molded around first end 215 of cord 213. In this capacity, head 215 and cord 213 are permanently jointed together to form unitary tie 211.

The primary distinction between tie 211 and tie 111 is that the particular shape of tab 221 (and, in particular, the inclusion and design of hole 239) eliminates the need for a locking tang or other similar cord engaging member in head 215, as will be explained further below. Rather, in use, second end 219 of cord 213 is designed to be wrapped around and/or fed through one or more desired items to be coupled together and cinched in a tight fashion. Second end 219 is then inserted upward through recess 239-1, end 219 is then tensioned driving cord 213 into the narrowing triangular portion 239-2 which cinches cord 213 in head 215. Second end 219 then enters into slotted feature 235 by sliding end 219 under the angled distal end 238 of finger 237; cord 213 is now effectively retained in its closed loop configuration by head 215. As such, tie 211 utilizes a simpler head construction to retain 213 in closed loop. Thereafter, second end 219 is penetrated down through circular portion 239-1 of hole 239, as represented by arrow D. By then sliding cord 213 outward within hole 239 and into wedged engagement within narrowing triangular portion 239-2, cord 213 is effectively retained in its closed loop configuration by head 213. As such, tie 211 utilizes a simpler head construction to retain cord 213 in a closed loop.

To open tie 211 from its closed loop configuration, second end 219 is urged outward and away from slotted feature 235, then inward away from triangular portion 239-2 of hole 239 and into alignment with circular portion 239-1. With second end 219 suitably disengaged from slotted feature 235 and within triangular portion 239-2, cord 213 can be easily withdrawn from head 215, thereby opening tie 211.

Figure 4:
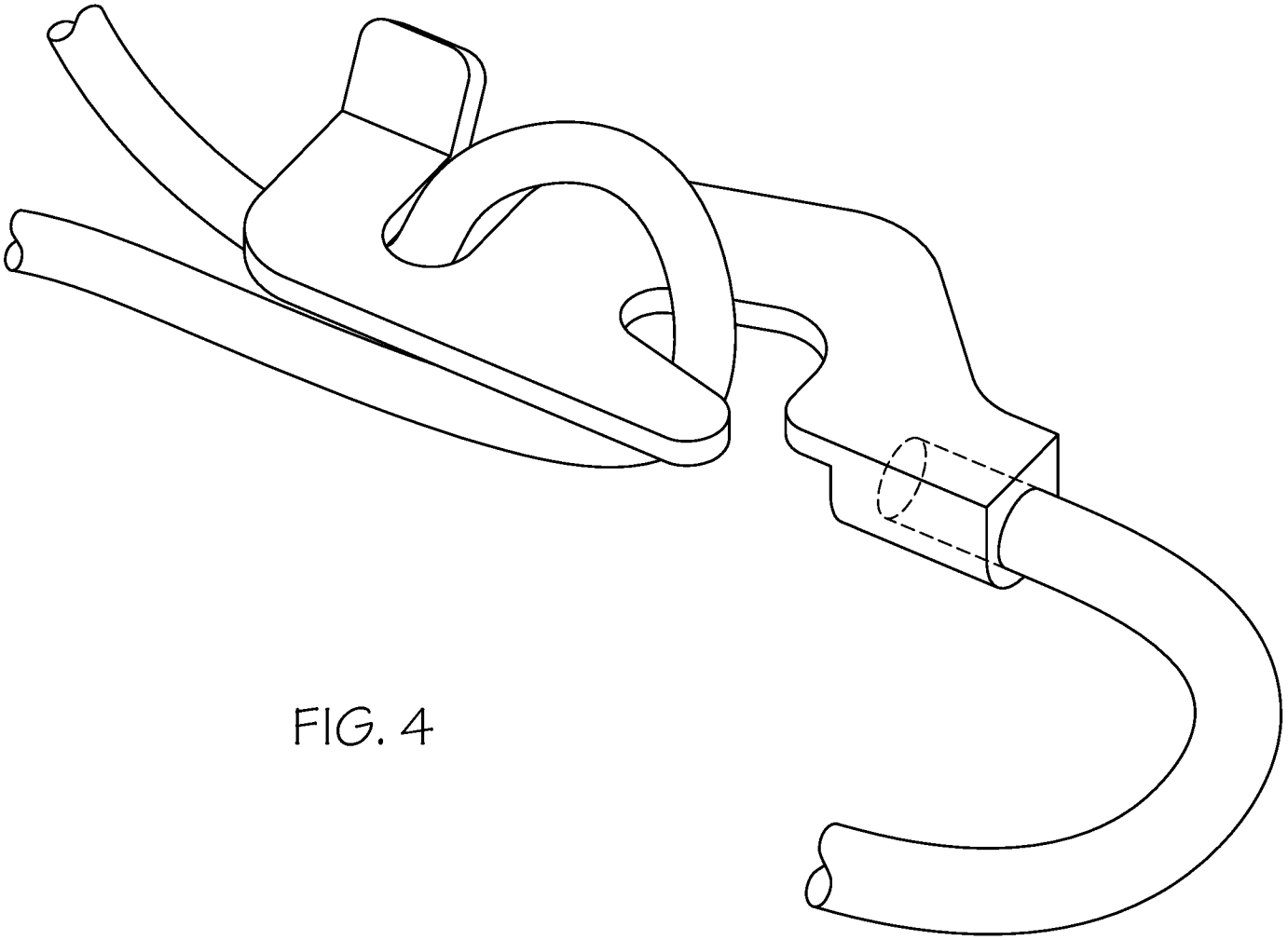
FIG. 4 illustrates an embodiment of a tie constructed according to the teaching of the present invention, in which the cord enters into a narrowing triangular portion of the head.

FIG. 4 is similar to FIG. 3. However FIG. 4 illustrates cord entry into a narrowing triangular portion of the head that is facilitate through a side opening in the recess hole feature.

Figure 5A:
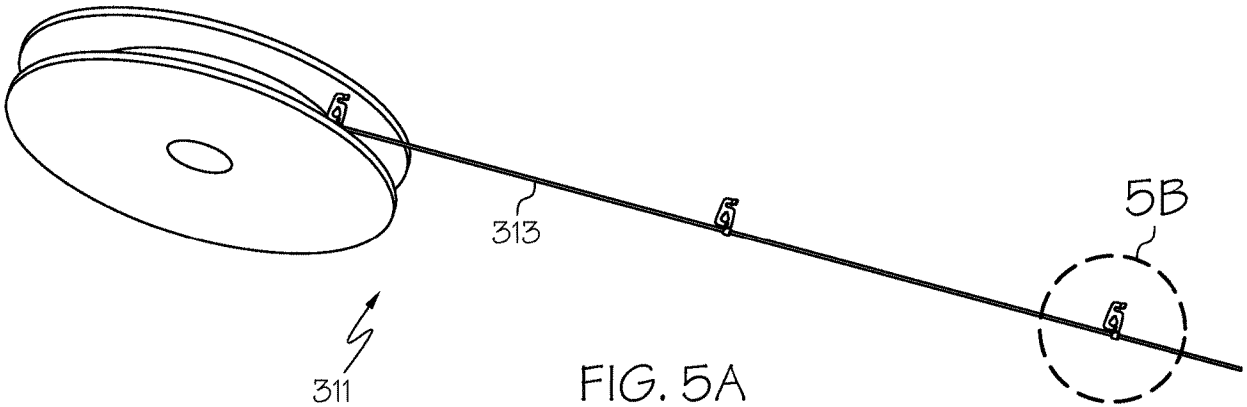
FIG. 5A illustrates an embodiment of a spool containing a contiguous chain of ties that can be singulated according to the teachings of the present invention.
Figure 5B:
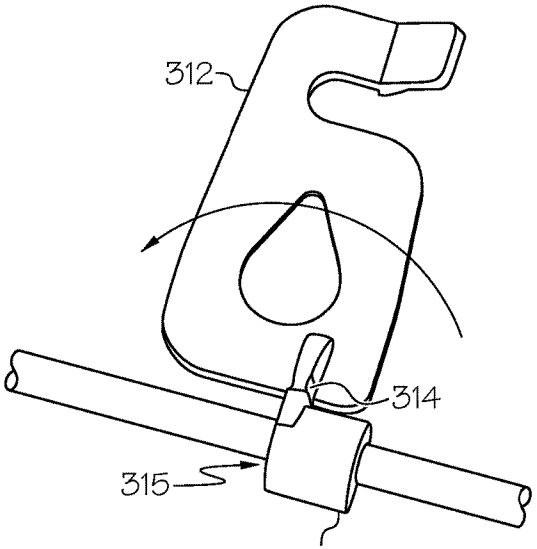
FIG. 5B is a detailed illustration of the embodiment of the spool containing a contiguous chain of ties illustrated in FIG. 5A.

As part of the manufacturing process, a multitude of plastic heads 312 can be placed on a paper based cord 313 and packaged on a reel to provide a contiguous chain of parts 311, as illustrated in FIGS. 5A and 5B.

As yet another part of the manufacturing process, the contiguous chain of parts 311 may have cord break feature 315, specifically, but not limited to, the intersections between the stem portion 316 and the paper based cord 313. This cord break off feature 315 is a weak point placed in the paper-based cord and such as a notch or score mark. The purpose of this feature is to make it easy for the user to singulate each tie on the contiguous chain.

Figure 6A:
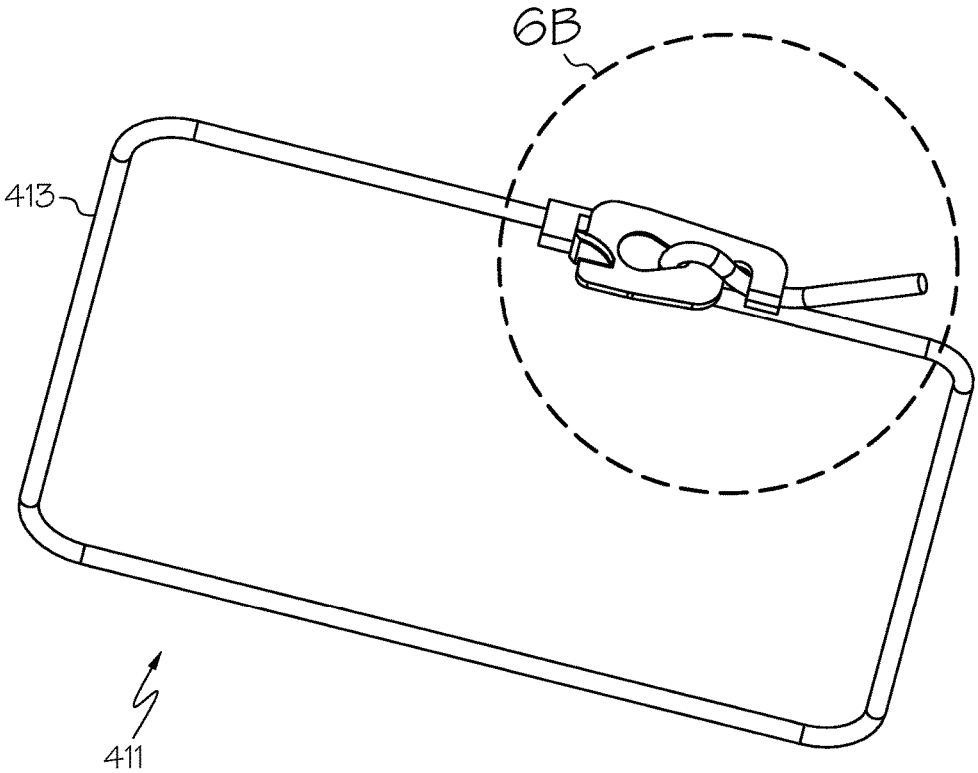
FIG. 6A illustrates an embodiment of the tie constructed according to the teaching of the present invention.
Figure 6B:
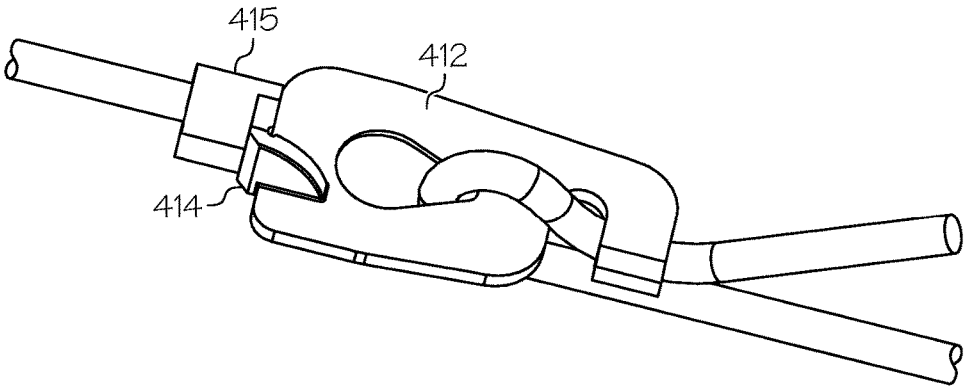
FIG. 6B is a detailed illustration of the embodiment of the tie illustrated in FIG. 6A.

Tie 411 in FIG. 6A and 6B, in one embodiment may comprise an elongated, paper-based cord 413 and a separate plastic head 412 that are permanently joined together by insert molding head 412 around a portion of cord 413.

FIG. 6 illustrates a plastic head 412 that contains a living hinge feature 414. When inserting the free end of cord 413 through plastic head 412 and tensioning the closed loop configuration of tie 411, the living hinge feature 414 deflects up to 90 degrees, placing the plastic head 412 in-line with the direction of tension. The living hinge feature, illustrated in FIG. 6A and FIG. 6B, is deflected up to a 90 degree angle from its as-molded position and the plastic head 412 is inserted into and in-line with the paper-based cord 413. The free end of the cord 413 is inserted into the plastic head 412 in order to form the tie into a closed loop configuration.

What is claimed is:

1. A tie, comprising:

(a) a paper-based cord having a first end and a second end; and (b) a plastic head insert molded around the first end of the paper-based cord, the plastic head being adapted to receive and selectively engage the paper-based cord to retain the tie in a closed loop configuration;

wherein the plastic head comprises a buckle that is shaped to define an elongated channel, the elongated channel being dimensioned to receive the paper-based cord; and wherein the plastic head further comprises a locking tang that is coupled to the buckle and is configured to extend into the elongated channel and selectively engage the paper-based cord and the locking tang comprises a free end that tapers so as to define a sharpened inner edge that is naturally biased to engage the paper-based cord when inserted through the elongated channel.

2. The tie as claimed in claim 1 wherein the cord is in the form of an elongated length of paper-based twine.

3. The tie as claimed in claim 1 wherein the buckle is in the form of a generally rectangular block that includes an open top wall, an open bottom wall, an enclosed inner end wall, an enclosed outer end wall, an enclosed left side wall, and an open right side wall that together define the elongated channel.

4. The tie as claimed in claim 3 wherein, with the tie formed in the closed-loop configuration, the paper-based cord can be subsequently extracted from the buckle through the open right side wall.

5. The tie as claimed in claim 1 wherein the locking tang is pivotally connected to the buckle and is naturally biased to engage the paper-based cord when inserted through the elongated channel.

6. The tie as claimed in claim 1 wherein the buckle includes at least one ratchet-shaped tooth, the at least one ratchet shaped tooth and a sharpened inner edge of the locking tang simultaneously engaging the paper-based cord when inserted through the elongated channel.

7. The tie as claimed in claim 1 wherein the plastic head further comprises a stem integrally formed on the buckle, the stem being inserted molded around the first end of the paper-based cord.

8. The tie as claimed in claim 1 wherein the plastic head further comprises a flange that is integrally formed onto and protrudes out from the buckle.

9. The tie as claimed in claim 1 wherein the plastic head additionally includes a clip for selectively retaining a section of the paper-cord that has been inserted through the elongated channel.

10. The tie as claimed in claim 9 wherein the clip includes a pair of opposing, outwardly deflectable, resilient fingers that are arranged to selectively retain the section of the paper-based cord that has been inserted through the elongated channel.

11. The tie as claimed in claim 1 wherein the plastic head is shaped to define an opening, the opening including first and second portions in communication with one another, the first portion of the opening being dimensioned to receive the paper-based cord, the plastic head engaging the paper-based cord only when disposed in the second portion of the opening.

12. The tie as claimed in claim 1 wherein the plastic head is in the form of an enlarged, planar tab that includes a flat top surface and a flat bottom surface, the opening extending transversely through the tab from the flat top surface to the flat bottom surface.

13. The tie as claimed in claim 12 wherein the plastic head further comprises a stem integrally formed onto the tab, the stem being inserted molded around the first end of the paper-based cord.

14. A spool of fasteners, comprising:

a plurality of fasteners wherein each fastener has a tie that is a paper-based cord having a first end and a second end; wherein each fastener has a plastic head insert molded around the first end of the paper-based cord, the plastic head being adapted to receive and selectively engage the paper-based cord to retain the tie in a closed loop configuration, and the plastic head includes a stem portion with a living hinge feature that deflects the stem in-line with a direction of tension.

15. The spool as claimed in claim 14, wherein the plurality of ties singulated into individual ties.

16. The spool claimed in claim 14, wherein there is a cord break off feature in the cord.

17. A tie, comprising:

(a) a cord made from a material selected from the following group: cotton, rayon, nylon, polyester, leather and wool and the cord having a first end and a second end; and (b) a plastic head insert molded around the first end of the cord, the plastic head being adapted to receive and selectively engage the cord to retain the tie in a closed loop configuration;

wherein the plastic head comprises a buckle that is shaped to define an elongated channel, the elongated channel being dimensioned to receive the cord; and wherein the plastic head further comprises a locking tang that is coupled to the buckle and is configured to extend into the elongated channel and selectively engage the cord and the locking tang comprises a free end that tapers so as to define a sharpened inner edge that is naturally biased to engage the cord when inserted through the elongated channel.

* * * * *